US008920255B2

(12) United States Patent
Davis et al.

(10) Patent No.: US 8,920,255 B2
(45) Date of Patent: Dec. 30, 2014

(54) POOL TABLE SYSTEM

(76) Inventors: Delroy Davis, Baltimore, MD (US); Barbara Davis, Baltimore, MD (US)

( * ) Notice: Subject to any disclaimer, the term of this patent is extended or adjusted under 35 U.S.C. 154(b) by 154 days.

(21) Appl. No.: 13/555,135

(22) Filed: Jul. 21, 2012

(65) Prior Publication Data

US 2014/0024468 A1 Jan. 23, 2014

(51) Int. Cl.
*A63D 13/00* (2006.01)
*A63D 15/00* (2006.01)

(52) U.S. Cl.
CPC ..... *A63D 15/00* (2013.01); *A63D 15/003* (2013.01)
USPC ..... 473/33; 473/42; 473/28

(58) Field of Classification Search
CPC ..... A63D 15/00; A63D 15/003
USPC ..... 473/1, 20, 28, 33
See application file for complete search history.

(56) References Cited

U.S. PATENT DOCUMENTS

| | | | | | |
|---|---|---|---|---|---|
| 264,165 | A | * | 9/1882 | Joergens | 473/7 |
| 1,188,136 | A | * | 6/1916 | Bajusz | 473/28 |
| 1,813,116 | A | * | 7/1931 | Clausen | 473/20 |
| 1,973,492 | A | * | 9/1934 | Linero | 473/25 |
| 2,014,788 | A | * | 9/1935 | Strickler et al. | 473/3 |
| 2,640,697 | A | * | 6/1953 | Elersich | 473/28 |
| 3,596,911 | A | * | 8/1971 | Kessler | 273/123 R |
| D223,538 | S | * | 5/1972 | Manning | D6/484 |
| 3,985,355 | A | * | 10/1976 | Shoemaker | 473/18 |
| 4,927,140 | A | | 5/1990 | Pappas | |
| 5,316,307 | A | * | 5/1994 | Kersh | 273/241 |
| D383,515 | S | * | 9/1997 | Wiebe et al. | D21/783 |
| D396,260 | S | * | 7/1998 | Wilson, Sr. | D21/784 |
| 6,319,141 | B1 | | 11/2001 | Cartee | |
| 6,494,788 | B1 | | 12/2002 | Gill et al. | |
| 6,712,710 | B2 | * | 3/2004 | Pearson | 473/10 |
| D489,784 | S | * | 5/2004 | Foley | D21/784 |
| 6,872,147 | B2 | | 3/2005 | Shih | |
| 7,654,911 | B2 | | 2/2010 | Cartwright | |
| 7,959,515 | B1 | | 6/2011 | Cruz | |
| D653,297 | S | | 1/2012 | Matulich | |
| 8,157,662 | B1 | | 4/2012 | McCoy et al. | |
| D661,760 | S | | 6/2012 | Astrand | |
| 2009/0082119 | A1 | * | 3/2009 | McCormick | 473/33 |
| 2011/0159975 | A1 | * | 6/2011 | Tasi | 473/33 |
| 2014/0024468 | A1 | * | 1/2014 | Davis et al. | 473/20 |

* cited by examiner

*Primary Examiner* — Mitra Aryanpour
(74) *Attorney, Agent, or Firm* — Debra G Shoemaker

(57) ABSTRACT

A pocket leg that has a cylindrical body, a base, and a top that forms a pool ball pocket is provided. The pocket leg can be used to form a rectangular pool table with six pockets constructed with six pocket legs. To each pocket leg are attached two brackets. The brackets of the four pocket legs that define the corners of the pool table are perpendicular to each other and the brackets of the two pocket legs that are centrally located are parallel to each other. Six brace pieces fit into the brackets and form the base of a table. The table also includes a top, apron and bumper railing. Pocket legs can be used to form a rectangular pool table with eight or more pockets. The pocket legs can form square, pentagonal, hexagonal, octagonal, or other polygonal shaped pool tables.

6 Claims, 9 Drawing Sheets

POOL TABLE SYSTEM

BACKGROUND OF THE INVENTION

1. Field of the Invention

The present invention relates to a pool table system for use in connection in playing a game such as pool and has particular utility in connection with providing means to add additional pockets to the playing surface.

2. Description of the Prior Art

The use of pool tables with different configurations is known in the prior art. Some patents describe unconventional table configurations. For example, U.S. Pat. No. 8,157,662 to McCoy et al described an L-shaped billiard table. U.S. Pat. No. 6,319,141 to Cartee described a pool table with 16 pockets. U.S. Pat. No. D661,760S described a dodecagonal table with six pockets. U.S. Pat. No. D653,297S described a cruciform billiard table. U.S. Pat. No. 6,494,788 to Gill et al described a hexagonal table. Other patents describe tables where part of the table is convertible. For example, U.S. Pat. No. 7,959,515 to Cruz described a table convertible from a rectangular to circular playing surface. U.S. Pat. No. 4,927,140 to Pappas described a table with movable rails. U.S. Pat. No. 6,872,147B2 to Shih described an easily assembling structure for a billiard table.

While the above-described devices fulfill their respective, particular objectives and requirements, the aforementioned patents do not describe a pool table system easily convertible to numerous shapes and sizes.

Therefore, a need exists for a new and improved pool table configuration system.

SUMMARY OF THE INVENTION

The general purpose of the present invention, which will be described subsequently in greater detail, is to system for constructing versatile pool table configurations.

To attain this, the present invention essentially comprises a pocket leg that has a cylindrical body and a base the touches the floor. The top of the pocket leg has a cavity and forms the letter "C" so as to make a pool ball pocket. The pocket leg body also has on the exterior a hole for apron alignment and a hole for bracket alignment.

The pocket leg can be used to form a rectangular pool table with six pockets constructed with six pocket legs. To each pocket leg are attached two brackets. The brackets of the four pocket legs that define the corners of the pool table are perpendicular to each other and the brackets of the two pocket legs that are centrally located are parallel to each other. Six brace pieces fit into the brackets and are secured to them by bolts. Two cross braces support a table top formed by three sections that each fit between a pair pocket legs. The top contains grooves that are complimentary to the pocket legs. Six apron sections and six railing pieces that fit between a pair of pocket legs and form a bumper railing around the table.

Similarly, the pocket legs can be used to form a rectangular pool table with eight, ten, twelve, sixteen or more pockets. The pocket legs can form pentagonal, hexagonal, octagonal, or other polygonal shaped pool tables. The pocket legs can form square pool tables with four, eight or more pockets.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Throughout the specification, the table of the present invention is referred to as a pool table. It is appreciated that the term billiards table or simple gaming table all equally describe and encompass the present invention.

It is therefore an object of the present invention to provide a new and improved pool table construction system.

It is still another object of the present invention to provide square, rectangular and other polygonal shaped tables.

In yet another object of the present invention, a pool table leg that contains a pocket and is a pool table building block is provided.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures and are briefly described below.

Figure 1:
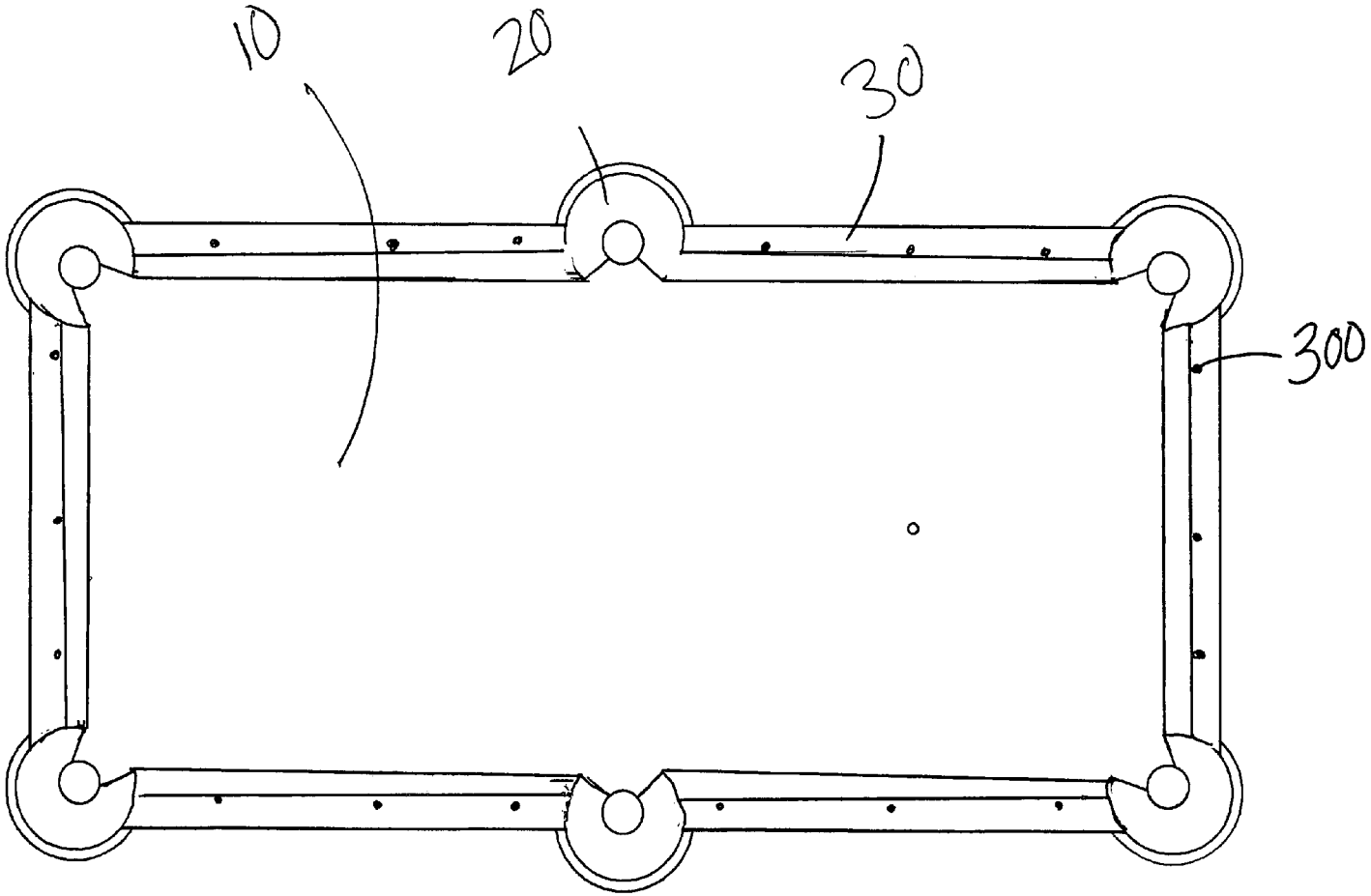
FIG. 1 is a top view of the pool table of the present invention with six pockets constructed in accordance with the principles of the present invention.

10 table top
20 pocket leg
30 bumper railing
40 bracket
50 braces
60 cross braces
70 grooves in table top
80 apron section
90 cylindrical body of pocket leg
100 base of pocket leg
120 holes in bracket through which screws secure bracket to pocket leg
130 holes in bracket through which bolts secure the brace to the bracket
140 apron alignment hole
150 stud of bracket
160 cap to cover bolt
170 bolt for attachment of apron to brace
180 spacer for attachment of apron to brace
190 washer for attachment of apron to brace
200 nut for attachment of apron to brace
210 apron stud for alignment with pocket leg
220 cutout in pocket leg for table top
230 hole in pocket body for stud 150 of bracket
240 hole in table top to secure top to brace 50
250 hole in table top to secure top to bumper railing 30
260 hole in brace for cross brace attachment
270 holes in brace for apron attachment
280 hole in apron for brace attachment
290 holes in top of brace for bumper railing attachment
300 markers or indicators on railing

DESCRIPTION OF THE PREFERRED EMBODIMENT

Referring now to the drawings, FIG. 1 is a top view of the pool table of the present invention with six pockets constructed in accordance with the principles of the present invention. As seen in FIG. 1, the pool table has a table top 10, six pocket legs 20, and a bumper railing 30. There are markers or indicators 300 located throughout the bumper railing to show a player how to line up for the most difficult shots, such as bank shots, etc.

Figure 2:
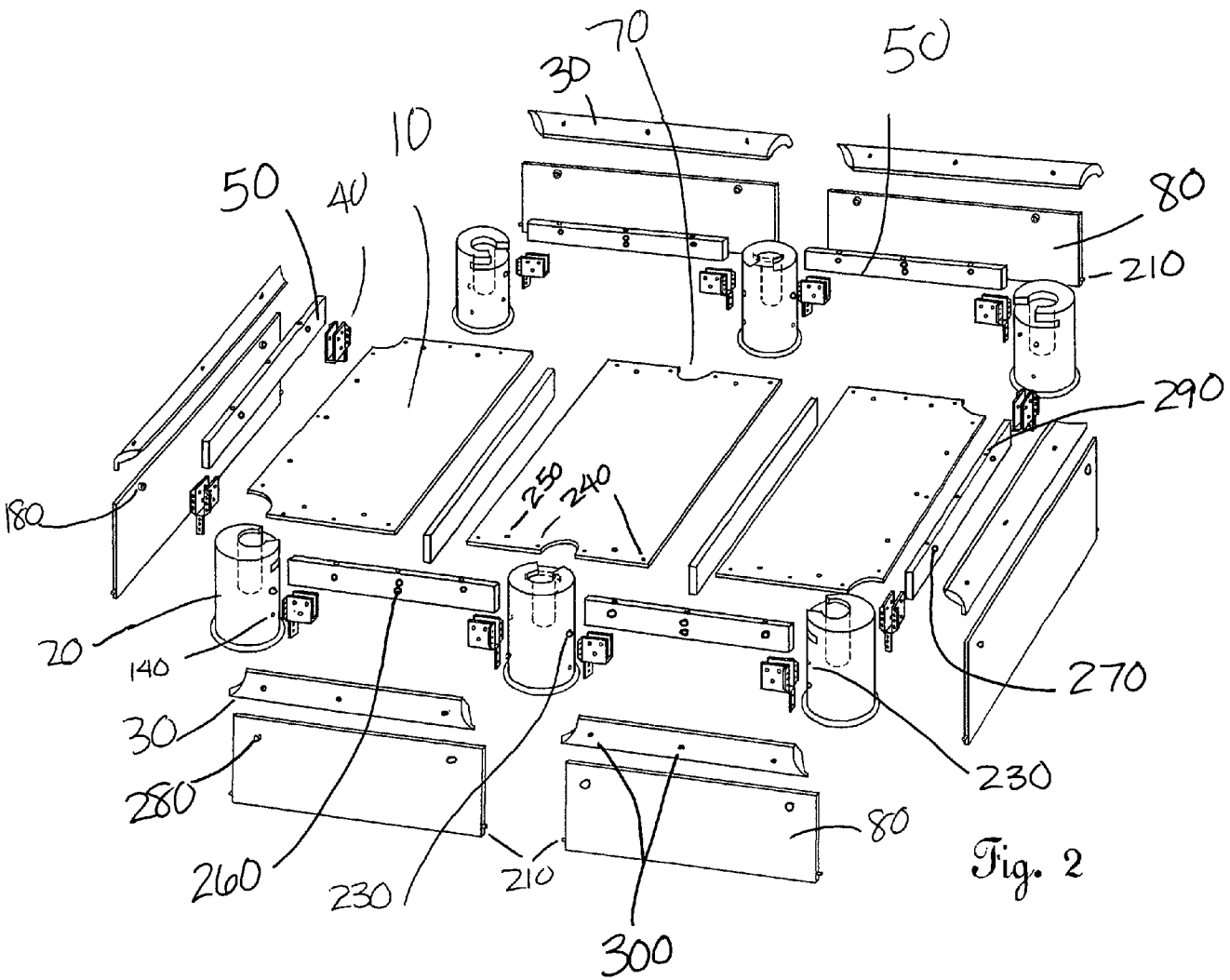
FIG. 2 is an exploded view of one preferred embodiment of the pool table with six pockets constructed in accordance with the principles of the present invention.

FIG. 2 is an exploded view of one preferred embodiment of the pool table with six pockets constructed in accordance with the principles of the present invention. Six pocket legs 20 are shown. Each pocket leg 20 is attached to two brackets 40. The brackets of the four pocket legs that define the corners of the pool table are perpendicular to each other and the brackets of the two pocket legs that are centrally located are parallel to each other. There are six brace pieces 50. The braces fit into a sleeve of the bracket. Four braces form the longer sides of the pool table and two braces from the shorter sides of the pool table. The braces are secured to the brackets by bolts placed through the six holes on each bracket. Two cross braces 60 are perpendicular to the four braces forming the longer sides of the pool table. The table top 10 is formed by three sections that each fit between a pair of pocket legs. The top contains grooves 70 that are complimentary to the pocket legs. The two end sections are mirror images of each other. The middle section is distinct because the location of the pocket legs is distinct. There are six apron 80 sections that fit between a pair of pocket legs and enclose the table. The apron sections have a stud 210 that aligns with hole 140 of the pocket leg. There are six railing 30 pieces that fit between a pair of pocket legs and form a bumper railing around the playing surface of the table. The pocket legs 20 have a hole 230 that aligns with stud 150 of bracket 40.

In a preferred embodiment the bumper railing is made of two materials. One a solid material, usually wood and the second usually a thick piece of rubber. The two pieces are glued together to form one piece called the bumper railing. The present invention also encompasses bumpers made of a single material or two materials attached to each other by other means. The present invention encompasses bumpers made of any type of material.

It can now be seen how the pool table system of the present invention is assembled. Brackets 40 are screwed onto pocket legs 20. Braces 50 are placed in sleeves of brackets and bolted thereto. Table top is placed onto braces and slid into cutout or slot of pocket legs. Screws and washers secure the table top to the braces through holes 240 in table top that located near the edge of the table top. Bumper railing 30 sits on top of the table top. Three screws and washers are inserted through holes 250 located in the table top 10 up into the bottom of the bumper railings 30 to secure the bumper railings to the top of the pool table. These holes are located further toward the center of the table that the brace holes. Cross braces meet the braces 50 at each end in a perpendicular fashion. A hole 260 in brace 50 permits a wood screw to be placed through the brace and secured to the cross brace. Apron is attached to brace with bolt, spacer washer and nut.

Figure 3:
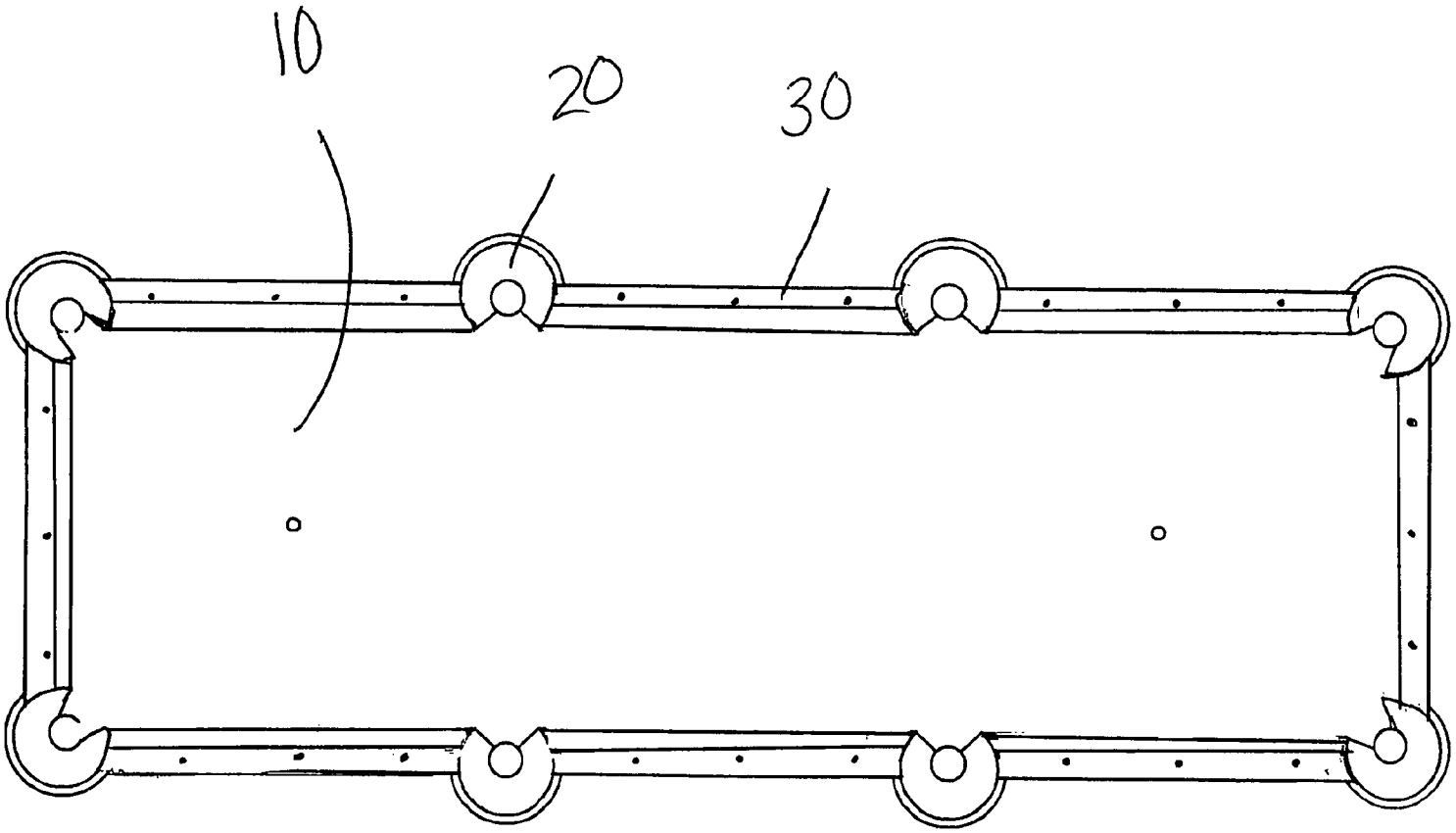
FIG. 3 is a top view of the pool table of the present invention with eight pockets constructed in accordance with the principles of the present invention.
Figure 4:
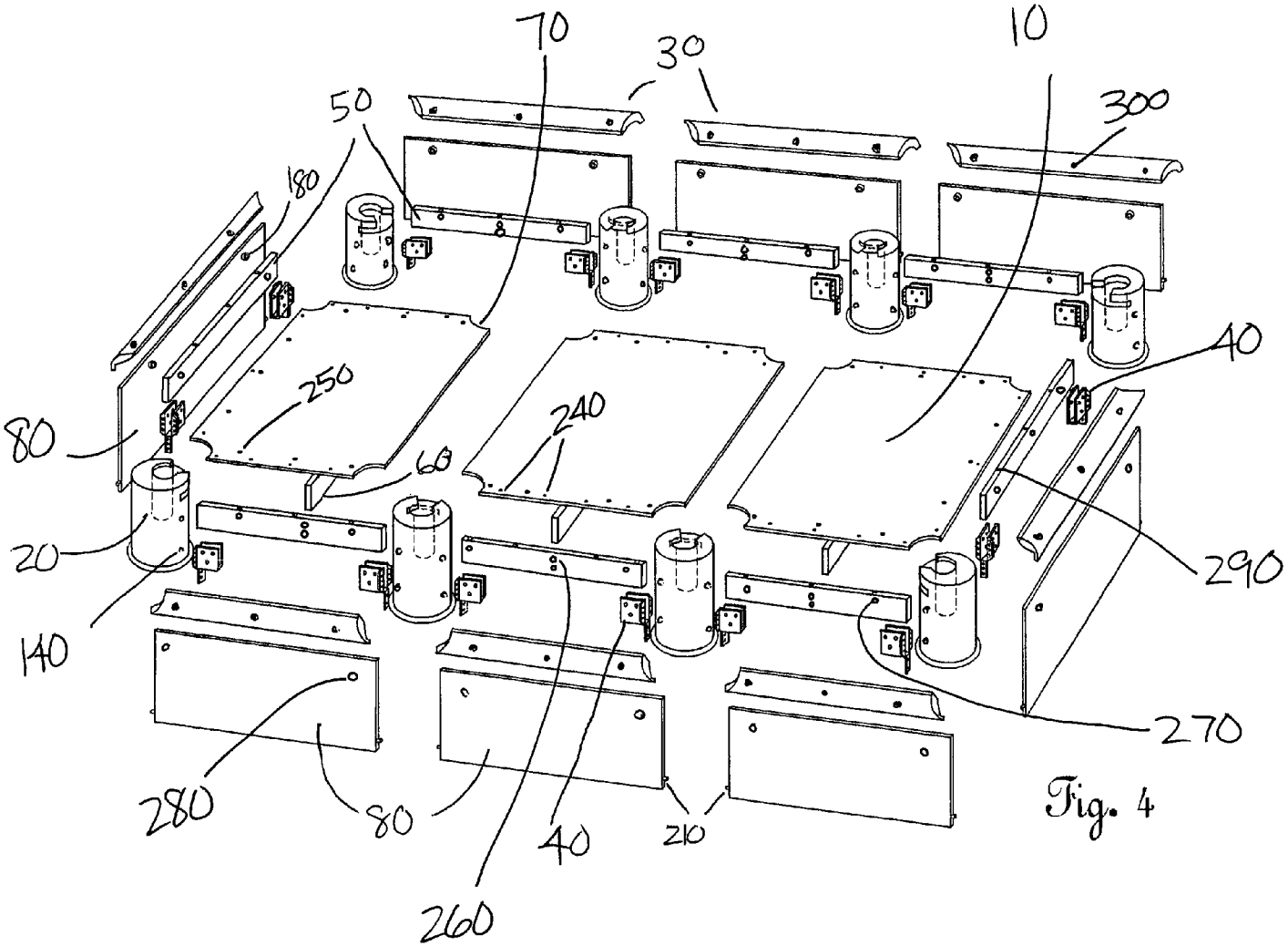
FIG. 4 is an exploded view of another embodiment of the pool table with eight pockets constructed in accordance with the principles of the present invention.

Referring now to FIGS. 3 and 4, another embodiment of the present invention is shown. FIG. 3 is a top view of the pool table of the present invention with eight pockets constructed in accordance with the principles of the present invention. The pool table of Figure has a table top 10, eight pocket legs 20, and a bumper railing 30. Similar to FIG. 2, FIG. 4 shows an exploded view of one preferred embodiment of the pool table with eight pockets constructed in accordance with the principles of the present invention. Eight pocket legs 20 are shown. Each pocket leg 20 is attached to two brackets 40. The brackets of the four pocket legs that define the corners of the pool table are perpendicular to each other and the brackets of the four pocket legs that are centrally located are parallel to each other. There are eight brace pieces 50. The braces fit into a sleeve of the bracket. Six braces form the longer sides of the pool table and two braces from the shorter sides of the pool table. The braces are secured to the brackets by bolts placed through the six holes on each bracket. Three cross braces 60 are perpendicular to the six braces forming the longer sides of the pool table. The table top 10 is formed by three sections that each fit between four pocket legs. The top contains grooves 70 that are complimentary to the pocket legs. In this case each section of the top is similar. There eight apron 80 sections that fit between a pair of pocket legs and enclose the table. There are eight railing 30 pieces that fit between a pair of pocket legs and form a bumper railing around the playing surface of the table.

Similarly, a rectangular pool table can be constructed similar to those shown in FIGS. 2 and 4 with four, twelve, fourteen, sixteen or any other combination of pocket legs with the appropriate braces, brackets, table tops, aprons and bumper railings.

For example, a square pool table with four pockets could be formed with four pocket legs, each pocket leg connected by screws to two brackets, with four braces that are accommodated by the eight brackets and a pool table top that fits between the four pocket legs and also including four apron sections and four railing pieces that fit between a pair of pocket legs.

Also, a rectangular pool table with ten pockets could be formed with ten pocket legs, each pocket leg connected by screws to two brackets; wherein, the brackets of the four pocket legs that define the corners of the pool table are perpendicular to each other and the brackets of the six pocket legs that are centrally located are parallel to each other. The table may also include eight braces that are accommodated by sixteen of the brackets that form the longer sides of the pool table and two braces that are accommodated by the remaining four brackets that form the shorter sides of the pool table, the braces being secured to the brackets by bolts placed in the holes indicated on the brackets. The table may also include four cross braces that are perpendicular to the eight braces forming the longer sides of the pool table, four sections of pool table top that each fit between four pocket legs, and ten apron sections and ten railing pieces that fit between a pair of pocket legs.

In yet another variation, a square pool table with eight pockets can be formed. For example, eight pocket legs, each pocket leg connected by screws to two brackets; wherein, the brackets of the four pocket legs that define the corners of the pool table are perpendicular to each other and the brackets of the remaining four pocket legs are parallel to each other. The table would further include eight braces that are accommodated at each end of each brace by one of the sixteen brackets, the braces being secured to the brackets by bolts placed in through holes on the brackets, two cross braces, two sections of pool table top that each fit between five pocket legs, eight apron sections and eight railing pieces that fit between a pair of pocket legs.

The pocket legs of the present invention may also form pool tables of other polygonal shapes. For example, a pentagonal pool table with five pockets may be formed using five pocket legs according, each pocket leg connected by screws to two brackets. In this case the brackets are placed at a 72° angle to each other so that the five pocket legs together may from a pentagon. The table would further include: five braces secured to the ten brackets by bolts placed in the holes indicated on the brackets, a pool table top that fits between the five pocket legs, and five apron sections and five railing pieces that fit between a pair of pocket legs.

In yet another pool table of the present invention, a hexagonal pool table with six pockets can be formed using six pocket legs, each pocket leg connected by screws to two brackets, wherein the brackets are placed at a 60° angle to each other so that the six pocket legs together form a hexagonal shape. The pool table will also include six braces that are bolted into the twelve brackets, a pool table top that fits between the six pocket legs and six apron sections and six railing pieces that fit between a pair of pocket legs.

In still another pool table of the present invention, an octagonal pool table with eight pockets can be formed from eight pocket legs, each pocket leg connected by screws to two brackets, wherein the brackets are placed at a 45° angle to each other so that eight pocket legs together form an octagonal shape. The pool table also including eight braces secured to sixteen brackets by bolts placed in the holes indicated on the brackets, a pool table top that fits between the eight pocket legs, and eight apron sections and eight railing pieces that fit between a pair of pocket legs.

As shown above, the pocket leg of the present invention provides incredible flexibility in planning the layout of a pool table. Pool tables with anywhere from four to sixteen or more pockets are envisioned. Similarly the pocket legs can be used to form square, rectangular, pentagonal, hexagonal, octagonal, or other polygonal shaped pool tables. The combination of a pocket leg, two brackets, a brace, an apron, and an railing piece form a basic building unit that can be used to form any desired pool table configuration.

Referring now to FIGS. 5-9, the pocket leg will be fully described.

Figure 5:
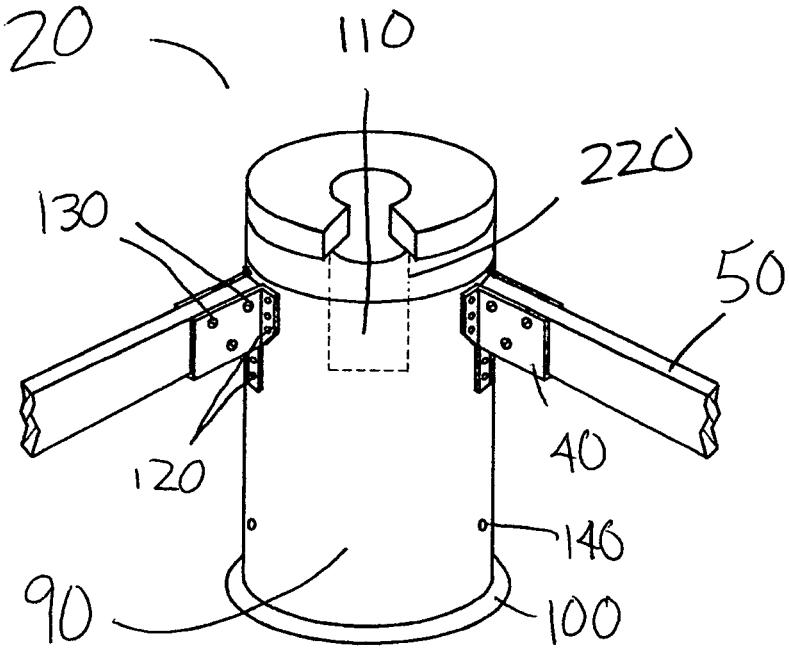
FIG. 5 is a perspective view of a pool table pocket leg constructed in accordance with the principles of the present invention

The pocket leg 20 is a cylindrical body 90 that includes at one end a base 100. The base rests on the floor. The base may be adjustable and/or include some leveling means so that the pool table may be adjusted to make it level. Means of leveling and adjusting pool table legs are known in the prior art, for example see U.S. Pat. No. 7,654,911 to Cartwright. The top of the pocket leg has a cavity 110 to accommodate pool balls. The cavity is located centrally on the top of the pocket leg and is deep enough to accommodate at least one pool ball but not so deep that the user cannot retrieve the balls after play. From the center of the cavity to the outer railing at one end of the pocket leg top is open so as to form a pool ball entry into the cavity. The top of the pocket legs forms the letter "C". Of course the depth and width of the cavity should accommodate not only a pool ball but also the hand and fingers of the player who wishes to remove the ball from the pocket after play. In FIG. 5, brackets 40 are secured to the pocket leg body by eight screws through the 8 holes of the bracket that meet the body of the pocket leg. Five of these holes 120 are shown in each bracket in FIG. 5, and the remaining 3 are hidden from view. FIG. 5 also shows a fragmentary view of two braces 50 accommodated in a sleeve formed by the bracket. The brace is secured to the bracket by three bolts placed through three holes of the bracket, through the brace, through the remaining three holes of the bracket and secured by a nut, or the like. Three of these holes 130 are shown on each bracket in FIG. 5, the remaining 3 are hidden from view. The pocket leg body also has on the exterior a hole for apron alignment 140. The pocket leg also has a cutout or slot 220 which will accommodate the table top.

Figure 6:
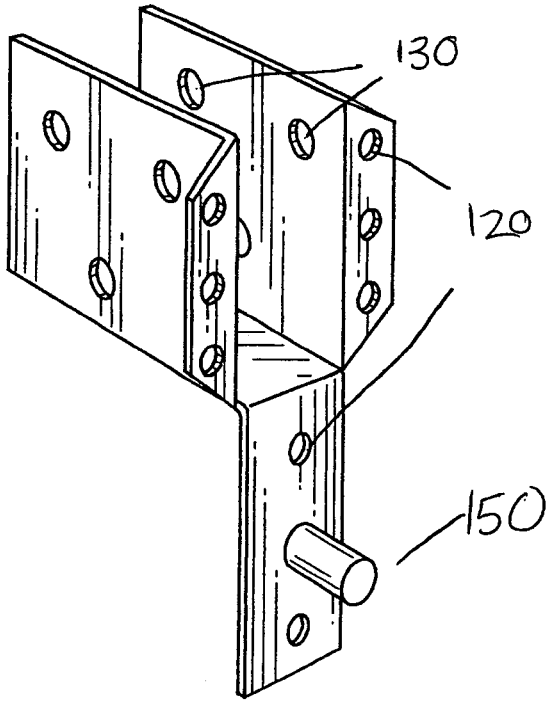
FIG. 6 is an enlarged perspective view of a bracket constructed in accordance with the principles of the present invention.

FIG. 6 is an enlarged perspective view of a bracket 40 constructed in accordance with the principles of the present invention. The bracket has a sleeve that accommodates the brace. The sleeve has six holes for bolt or screw placement 130, three on each side of the sleeve that are aligned with each other. The width and depth of the sleeve are complimentary to the brace. The bracket has eight holes 120 for screw placement to secure the bracket to a pocket leg body. The bracket also has a stud 150 that is complimentary to a hole of the pocket leg body to aide in placement of the bracket on the pocket leg body. The stud may be integral with the bracket or added after bracket manufacture and attached thereto by any means. The width and length of the stud may of course be varied as needed.

Of course the length, width and depth of the bracket may be changes as needed to fit any brace or any pocket leg. Further, while a metal bracket is preferred, the material of the bracket may be changed to suit the needs of the user. Finally, although bolts and screws are mentioned to secure the bracket to the pocket leg and the brace to the bracket and the apron to the brace, the present invention encompasses any fastening means available to the user.

Figure 7:
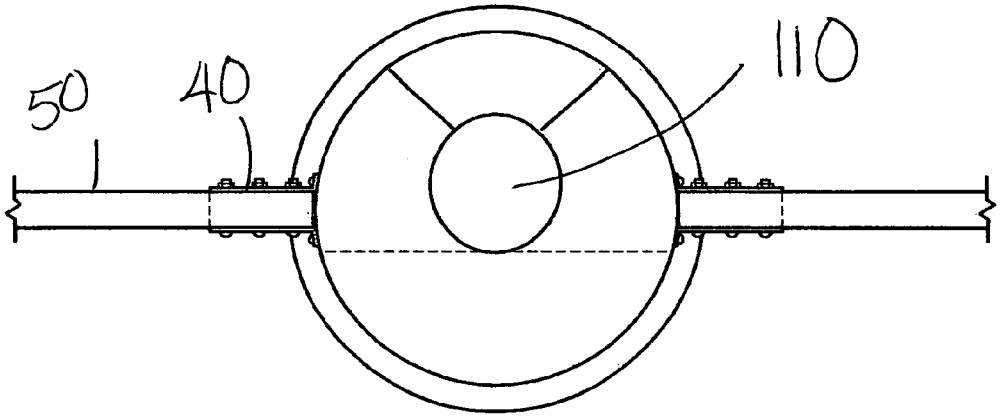
FIG. 7 is a top view of view of a pool table pocket leg constructed in accordance with the principles of the present invention

FIG. 7 is a top view of view of a pool table pocket leg constructed in accordance with the principles of the present invention. A fragmentary view of the brace 50 can be seen. The bracket 40 with bolts attached is also shown. The top of the pocket leg body showing the centrally located cavity 110 is also shown. The dashed line shows where the table top aligns with the pocket leg.

Figure 8:
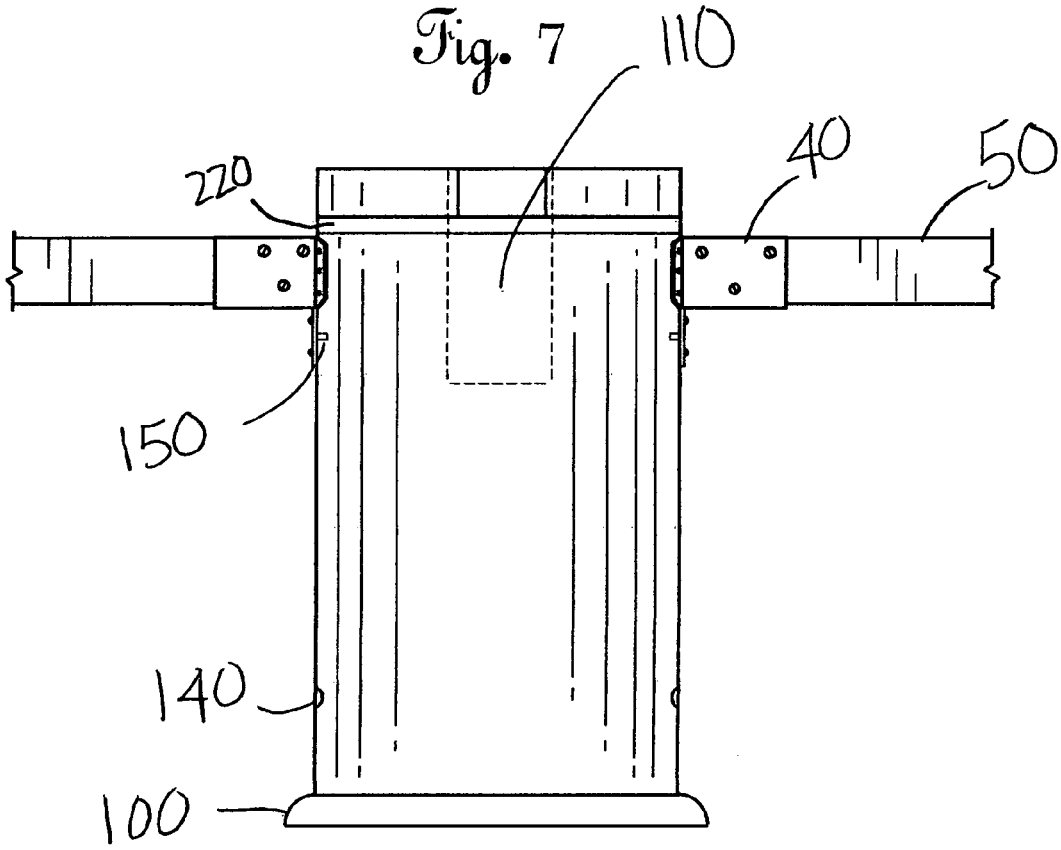
FIG. 8 is a side view of a pool table pocket leg constructed in accordance with the principles of the present invention.

FIG. 8 is a side view of a pool table pocket leg constructed in accordance with the principles of the present invention. A fragmentary view of the brace 50 can be seen. The bracket 40 is also seen. The stud 150 of the bracket which lines up with a hole in the pocket leg body is shown. The cavity 110 is represented as a dashed line. The base 100 is also shown. The table top slides into the cutout 220 of the pocket leg. It can be seen that a section from the center of the cavity to the outer edge of the top at one end is open in a "C" shape so as to form a pool ball entry into the cavity and also includes a slot to accept a pool table top.

While the concept of a pocket leg has been described it is appreciated that variations of this leg are also encompassed by the present invention. The key elements of the pocket leg are mating with brackets and the cavity for reception of pool balls. The exterior of the pocket leg body may be of a spindle shape or any other basic or decorative shape and made of any material provided the leg can be secured to two brackets and contains a cavity for reception of at least one pool ball.

Figure 9:
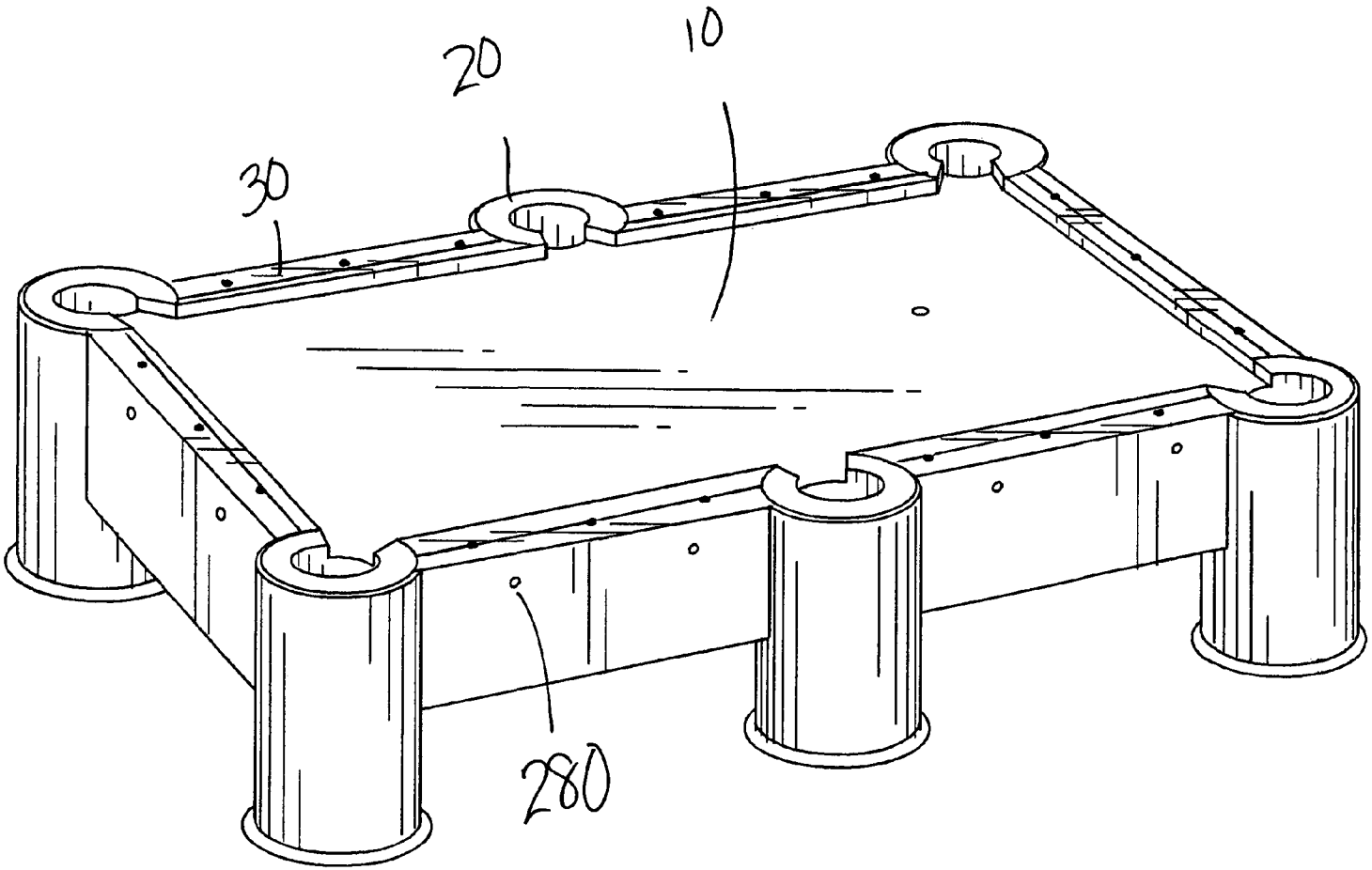
FIG. 9 is a perspective view of the pool table of the present invention with 6 six pockets constructed in accordance with the principles of the present invention.

FIG. 9 is a perspective view of the pool table of the present invention with six pockets constructed in accordance with the principles of the present invention. The six pocket legs 20 are connected by brackets as braces as described above. The apron 80 is placed between the pocket legs. The bumper railing 30 is placed between the pocket legs so that it meets the open railing of the pocket leg top at the ball entry point. The bumper railing is flush with each pocket leg pool ball entry point and also flush with the table top to create a continuous surface. Two holes are indicated in apron 80 for attachment to brace as described below.

Figure 10:
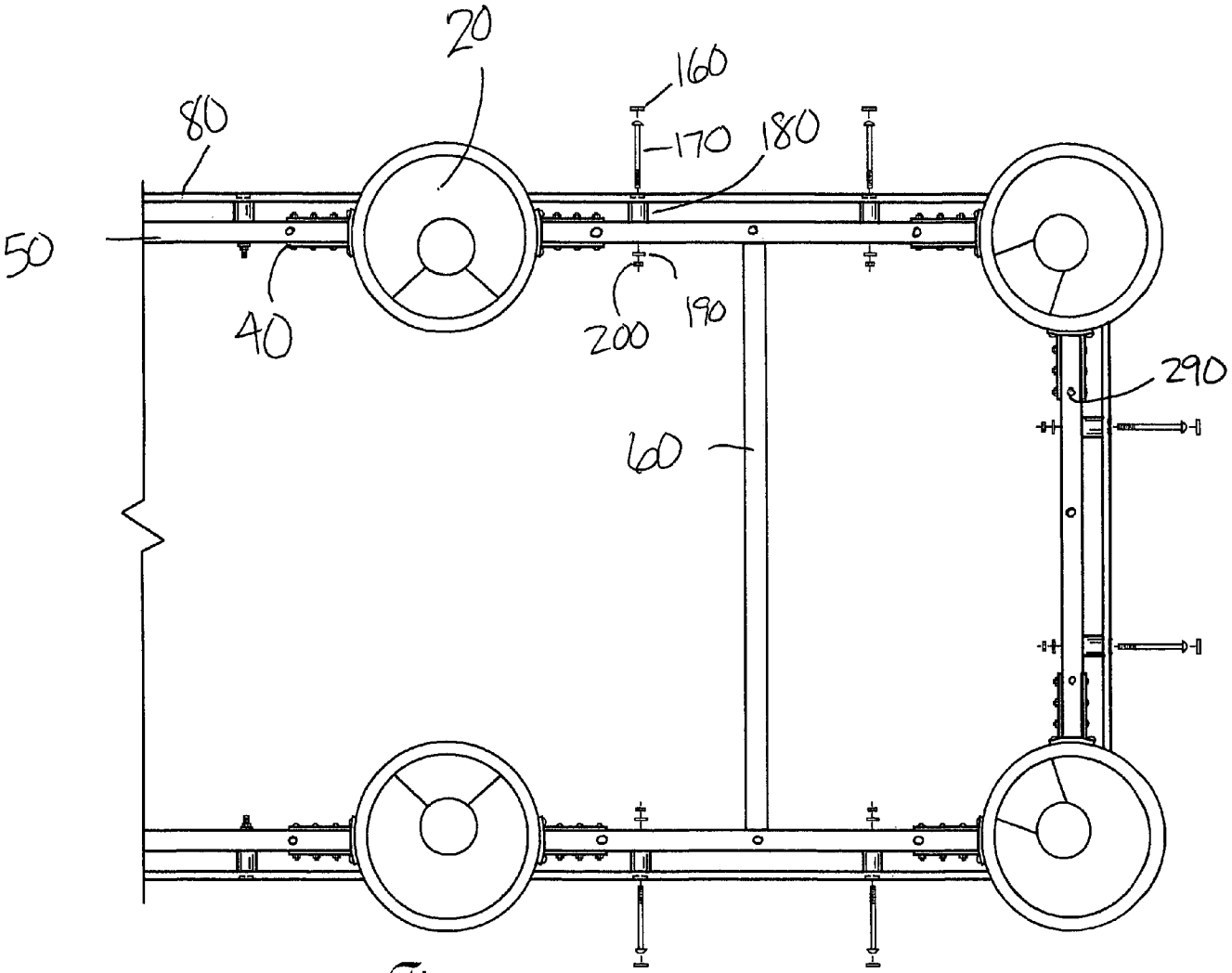
FIG. 10 is a fragmentary cut away top view of the pool table of the present invention constructed in accordance with the principles of the present invention.
Figure 11:
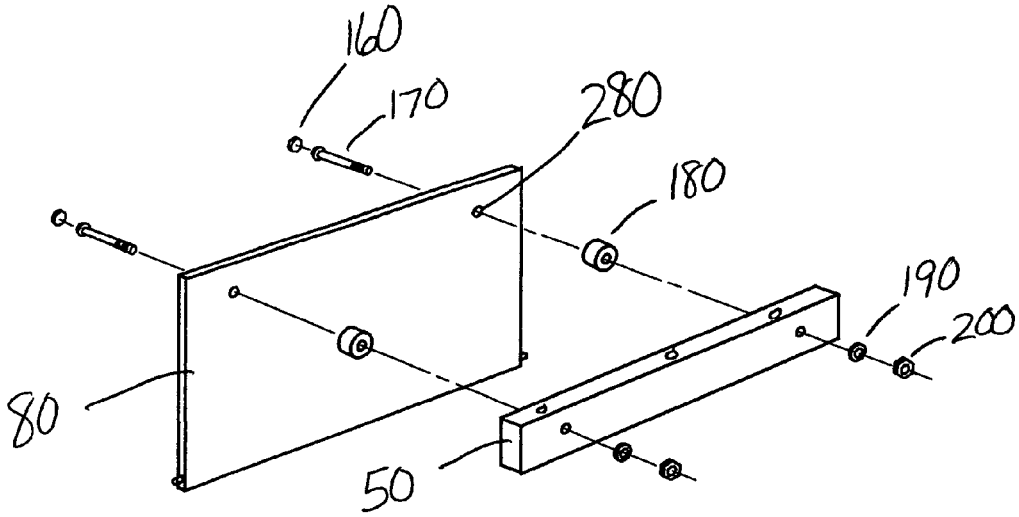
FIG. 11 is an exploded view of hardware in the pool table constructed in accordance with the principles of the present invention.

FIGS. 10 and 11 demonstrate attachment of the apron to the brace between two pocket legs. Bolt 170 goes through hole 280 in apron 80. A spacer 180 is placed on bolt between apron 80 and brace 50. The bolt 170 goes through hole 270 in brace and is secured on the opposite side of the brace with washer 190 and nut 120. The exterior of bolt 170 is covered with cap 160. The dashed line indicates the direction of the bolt through the apron and brace.

It is also noted in FIG. 10 that cross brace 60 meets perpendicular to brace 50 at each end. Sharp wood screws and washers are fastened from the apron side of the brace, through the brace, and ending in the cross brace. Holes for wood screw entry 260 are shown in FIG. 2.

The present invention, as demonstrated by numerous embodiments, is extremely versatile and provides a system to easily set up a variety of pool table shapes and playing surfaces with a few pieces.

The present invention has the following advantages. Pool tables may easily be made in numerous shapes and configurations using only a few pieces.

While a preferred embodiment of the pool table has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as wood, metal, plastic, fiberglass, marble, felt, prefelted marble or slate, particle board, cardboard may be used. And although a novel pool table has been described, it should be appreciated that the table configuration is also suitable for a wide variety of table with pocket games. Furthermore, a wide variety of thicknesses of materials or basic shape and size of the table may be varied.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A plurality of pool table support legs fdr supporting a playing surface and for receiving and holding pool balls, each of said plurality of support legs comprising:

a cylindrical body having an upper end and a lower end;

a base attached to the lower end of the cylindrical body for positioning the support leg on a support surface;

a cavity formed centrally in the upper end of the cylindrical body, said cavity forming a central pocket for receiving pool balls, wherein a front segment of the cylindrical body and a front segment of the cavity include an opening which form a C-shaped entry for receiving pool balls;

a slot or cutout formed below the C-shaped opening of said cylindrical body, wherein a portion of said playing surface is slidably received and secured within each slot or cutout of said cylindrical body;

a pair of brackets attached to said cylindrical body, wherein a support brace is securely received within said pair of brackets; a plurality of holes formed in an outer surface of the cylindrical body; and a plurality of apron sections, wherein a plurality of studs are received within the plurality of holes for securely attaching said plurality of apron sections to the cylindrical body of each of said plurality of support legs.

2. The plurality of pool table support legs of claim 1, wherein the plurality of support legs are six support legs and the playing surface is formed of three sections, wherein the pair of brackets are placed at a 60° angle to each other.

3. The plurality of pool table support legs of claim 1, wherein the plurality of support legs are eight support legs and the playing surface is formed of three sections, wherein the pair of brackets are placed at a 45° angle to each other.

4. The plurality of pool table support legs of claim 1, wherein the plurality of support legs are four support legs and the playing surface is formed of three sections.

5. The plurality of pool table support legs of claim 1, wherein the plurality of support legs are five support legs and the playing surface is formed of three sections, wherein the pair of brackets are placed at a 72° angle to each other.

6. The plurality of pool table support legs of claim 1, wherein the plurality of support legs are ten support legs and the playing surface is formed of three sections.

* * * * *